US008729822B2

(12) United States Patent
Chung et al.

(10) Patent No.: US 8,729,822 B2
(45) Date of Patent: May 20, 2014

(54) LED EMITTING DEVICE AND DRIVING METHOD THEREOF

(75) Inventors: Jinhwa Chung, Seoul (KR); Frank Chang, Hsinchu (TW); Byunghak Ahn, Seoul (KR); Moonho Choi, Bucheon (KR)

(73) Assignee: Fairchild Korea Semiconductor Ltd., Bucheon (KR)

( * ) Notice: Subject to any disclaimer, the term of this patent is extended or adjusted under 35 U.S.C. 154(b) by 474 days.

(21) Appl. No.: 13/191,174

(22) Filed: Jul. 26, 2011

(65) Prior Publication Data

US 2012/0032611 A1 Feb. 9, 2012

(30) Foreign Application Priority Data

Aug. 5, 2010 (KR) ..... 10-2010-0075543

(51) Int. Cl.
*H05B 37/02* (2006.01)

(52) U.S. Cl.
USPC ..... 315/291; 315/224; 315/302; 315/312; 315/360

(58) Field of Classification Search
CPC ..... H05B 33/0833; H05B 33/0893; H05B 33/0827; H05B 33/0818
USPC ..... 315/209 R, 210, 224, 291, 294, 297, 315/302, 307, 312, 360
See application file for complete search history.

(56) References Cited

U.S. PATENT DOCUMENTS

| | | | | |
|---|---|---|---|---|
| 8,436,553 | B2 * | 5/2013 | Zampini et al. | 315/291 |
| 8,519,642 | B2 * | 8/2013 | Ahn et al. | 315/312 |
| 2010/0264832 | A1 * | 10/2010 | Archenhold et al. | 315/152 |

OTHER PUBLICATIONS

MAX17061—8-String White LED Driver with SMBus for LCD Panel Applications, Jan. 2008, pp. 1-26, Maxim Integrated Products.
Advance Information CAT4026—6-Channel LED controller with Fault Diagnostic for Large Panel LED Backlighting, 2008 SCILLC, pp. 1-15, ON Semiconductor.

* cited by examiner

*Primary Examiner* — Haiss Philogene
(74) *Attorney, Agent, or Firm* — Okamoto & Benedicto LLP

(57) ABSTRACT

The present invention relates to an LED emitting device and a driving method thereof including at least two LED channels. If a power source voltage supplied to an LED emitting device reaches a predetermined threshold voltage, the power source voltage is maintained as a threshold voltage during an over-voltage regulation period.

16 Claims, 3 Drawing Sheets

LED EMITTING DEVICE AND DRIVING METHOD THEREOF

CROSS-REFERENCE TO RELATED APPLICATION

This application claims priority to and the benefit of Korean Patent Application No. 10-2010-0075543 filed in the Korean Intellectual Property Office on Aug. 5, 2010, the entire contents of which are incorporated herein by reference.

BACKGROUND (a) Field

The present invention relates to a LED emitting device and a driving method thereof. More particularly, the present invention relates to an LED emitting device and a driving method thereof controlling an overvoltage generated when driving the LED.

(b) Description of the Related Art

A light emitting device (hereafter, an LED emitting device) using LEDs supplies currents to the LEDs so as to drive them. Then, the LEDs emit beams having brightness corresponding to the currents. Such an LED light emitting device can be used as a light source for an LCD or for lighting.

An LED light emitting device emits light having brightness by making a predetermined current flow in each LED channel including a plurality of LEDs connected in series in a voltage application state of more than a threshold voltage. The threshold voltage is a minimum voltage required to turn on a plurality of LEDs forming the LED channel.

The operation of emitting the light by supplying the current to the LED channel is referred to as a turn-on, and the operation stopping the light emitting by blocking the current supply to the LED channel is referred to as a turn-off.

The LED emitting device includes a plurality of LED channels, and constantly controls a current flowing in each of the plurality of LED channels The plurality of LED channels are coupled in parallel such that power source voltages respectively applied to the plurality of LED channels are the same. The power source voltage is increased/decreased according to increasing/decreasing the number of turned on LED channels among the plurality of LED channels. That is, if the number of turned on LED channels is increased, the power source voltage is decreased, and if the number of the turned on LED channels is decreased, the power source voltage is increased.

Thus, the LED emitting device detects the increasing/decreasing of the power source voltage to constantly control the power source voltage. Generally, the LED emitting device constantly controls the power source voltage with reference to the lowest voltage among the channel voltages. The channel voltage as a voltage of an end of the LED channel means the voltage of which the voltage of both terminals of the LED channel is subtracted from the power source voltage. The power source voltage must be controlled with reference to the lowest channel voltage among the plurality of LED channel voltages, and thereby a plurality of LEDs of all LED channels may be turned on by the power source voltage.

That is, the LED channel having the lowest channel voltage means that the voltage between both terminals of the LED channel is highest. If the power source voltage is less than the highest voltage among the voltages between both terminals generated when the constant current flows in the LED channel, the power source voltage is less than the threshold voltage such that current required for the LED channel to emit light may not be supplied. Accordingly, the power source voltage is controlled with reference to the lowest channel voltage of the plurality of LED channel voltages.

The lowest channel voltage of the plurality of LED channel voltages is maintained to the time that the channel voltage is sampled in the LED emitting device and the further lower LED channel voltage is generated. When the number of turned on LED channels is decreased, the power source voltage is increased, and the voltage that is less than the sampled LED channel voltage is not generated. If the sampled LED channel voltage is maintained in this state, an overvoltage phenomenon of the power source voltage is generated.

To prevent this, if the power source voltage is increased to a predetermined overflow reference voltage, the LED emitting device controls the power source voltage such that the power source voltage is decreased to a predetermined stabilization voltage.

During a period from the time that the power source voltage is increased to the overflow reference voltage to the time that it is decreased to the stabilization voltage, the number of turned on LED channels among the plurality of LED channels may be increased. Thus, this period is a period in which the power source voltage is decreased such that it may be difficult to supply the constant current to the LED channel. That is, the LED channel that is not turned on is generated before the power source voltage is increased to the appropriate voltage to supply the constant current to all LED channels that must be turned on.

As described above, when the overvoltage of the power source voltage is generated such that the number of LED channels that must be turned on is increased during the period in which the power source voltage is stabilized, a serious problem that the turn-on time of the LED channel is delayed is generated.

The above information disclosed in this Background section is only for enhancement of understanding of the background of the invention and therefore it may contain information that does not form the prior art that is already known in this country to a person of ordinary skill in the art.

SUMMARY

Embodiments of the present invention relate to an LED emitting device and a driving method thereof that are capable of turning on an LED channel stably supplying a power source voltage.

An LED emitting device according to an embodiment of the present invention includes at least two LED channels. The LED emitting device includes: a power source supplying device supplying a power source voltage to one terminal of at least two LED channels; and at least two channel current controllers connected to the other terminal of the at least two LED channels, and controlling a duty of a driving current respectively flowing in at least two LED channels, wherein the power source supplying device maintains the power source voltage as the threshold voltage during an overvoltage regulation period if the power source voltage reaches a predetermined threshold voltage.

The LED emitting device further includes a first error amplifier amplifying a voltage of which a divided voltage corresponding to the power source voltage is subtracted from a predetermined reference voltage to generate an overvoltage sensing voltage. The power source supplying device maintains the power source voltage as the threshold voltage if the overvoltage sensing voltage becomes a voltage that is less than a predetermined overvoltage reference voltage. The overvoltage reference voltage is set as the overvoltage sensing voltage when the power source voltage is the threshold voltage.

Alternatively, the LED emitting device further includes a first error amplifier amplifying the voltage of which the predetermined reference voltage is subtracted from the divided voltage corresponding to the power source voltage to generate an overvoltage sensing voltage, and the power source supplying device maintains the power source voltage as the threshold voltage if the overvoltage sensing voltage is the larger voltage than the predetermined overvoltage reference voltage. The overvoltage reference voltage is set as the overvoltage sensing voltage when the power source voltage is the threshold voltage.

The LED emitting device further includes: at least two sample/hold units sampling and holding a channel minimum voltage of each channel voltage of the at least two LED channels; and a minimum voltage detector detecting the smaller voltage among at least two channel minimum voltages to generate as a minimum voltage, wherein the power source supplying device controls the power source voltage by using an error signal generated by amplifying the difference between the minimum voltage and the predetermined reference voltage such that the minimum voltage becomes the same voltage as the reference voltage.

The LED emitting device may further include a first error amplifier amplifying a voltage of which a divided voltage corresponding to the power source voltage is subtracted from a predetermined reference voltage to generate an overvoltage sensing voltage, and the power source supplying device maintains the power source voltage as the threshold voltage if the overvoltage sensing voltage becomes the voltage that is less than a predetermined overvoltage reference voltage.

Alternatively, the LED emitting device further includes a first error amplifier amplifying the voltage of which the predetermined reference voltage is subtracted from the divided voltage corresponding to the power source voltage to generate an overvoltage sensing voltage, and the power source supplying device maintains the power source voltage as the threshold voltage if the overvoltage sensing voltage is the larger voltage than the predetermined overvoltage reference voltage.

A method for driving an LED emitting device including at least two LED channels according to an embodiment of the present invention includes supplying a power source voltage to one terminal of at least two LED channels, and maintaining the power source voltage as a threshold voltage during an overvoltage regulation period if the power source voltage reaches a predetermined threshold voltage.

The method further includes amplifying a voltage of which a divided voltage corresponding to the power source voltage is subtracted from a predetermined reference voltage to generate an overvoltage sensing voltage, and maintaining the power source voltage as the threshold voltage if the overvoltage sensing voltage becomes the voltage that is less than a predetermined overvoltage reference voltage. The overvoltage reference voltage is set as the overvoltage sensing voltage when the power source voltage is the threshold voltage.

Alternatively, the method further includes amplifying the voltage of which the predetermined reference voltage is subtracted from the divided voltage corresponding to the power source voltage to generate an overvoltage sensing voltage, and maintaining the power source voltage as the threshold voltage if the overvoltage sensing voltage is the larger voltage than the predetermined overvoltage reference voltage. The overvoltage reference voltage is set as the overvoltage sensing voltage when the power source voltage is the threshold voltage.

The method further includes: sampling and holding a channel minimum voltage of each channel voltage of the at least two LED channels; detecting the smaller voltage among at least two channel minimum voltages to generate as a minimum voltage; and controlling the power source voltage by using an error signal generated by amplifying the difference between the minimum voltage and the predetermined reference voltage such that the minimum voltage becomes the same voltage as the reference voltage.

The method further includes amplifying a voltage of which a divided voltage corresponding to the power source voltage is subtracted from a predetermined reference voltage to generate an overvoltage sensing voltage, and maintaining the power source voltage as the threshold voltage if the overvoltage sensing voltage becomes the voltage that is less than a predetermined overvoltage reference voltage.

The method further includes amplifying the voltage of which the predetermined reference voltage is subtracted from the divided voltage corresponding to the power source voltage to generate an overvoltage sensing voltage, and maintaining the power source voltage as the threshold voltage if the overvoltage sensing voltage is the larger voltage than the predetermined overvoltage reference voltage.

According to embodiments of the present invention, the power source voltage turns on the LED channel without a delay is stably supplied.

DETAILED DESCRIPTION OF THE EMBODIMENTS

Figure 1:
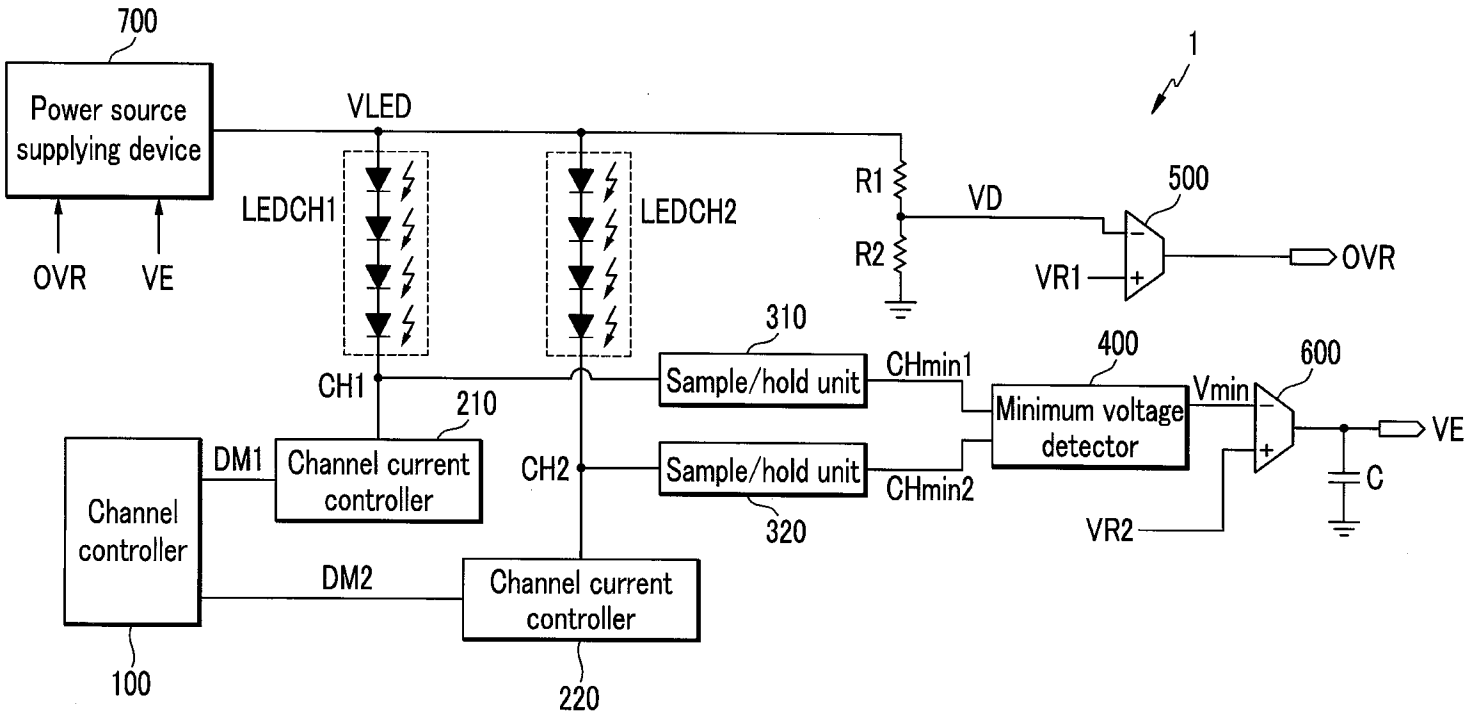
FIG. 1 is a view showing an LED emitting device according to an embodiment of the present invention.

In the following detailed description, only certain embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. The drawings and description are to be regarded as illustrative in nature and not restrictive, and life reference numerals designate like elements through the specification.

Throughout this specification and the claims which follow, when it is described that an element is "coupled" to another element, the element may be "directly coupled" to the other element or "electrically coupled" to the other element through a third element.

In addition, unless explicitly described to the contrary, the word "comprise" and variations such as "comprises" or "comprising" will be understood to imply the inclusion of stated elements but not the exclusion of any other elements.

The present invention will be described more fully hereinafter with reference to the accompanying drawings, in which embodiments of the invention are shown to be realized by a person skilled in the art.

FIG. 1 is a view showing an LED emitting device according to an embodiment of the present invention.

As shown in FIG. 1, an LED emitting device 1 includes two LED channels LEDCH1 and LEDCH2, a channel controller 100, two channel current controllers 210 and 220, two sample/hold units 310 and 320, a minimum voltage detector 400, a first error amplifier 500, a second error amplifier 600, a power source supplying device 700, two dividing resistors R1 and R2, and a capacitor C.

The LED emitting device according to an embodiment of the present invention includes two LED channels, however the present invention is not limited thereto. That is, the LED emitting device may include at least two LED channels. The number of channel current controllers and sample/hold units is determined according to the number of the plurality of LED channels. Accordingly, when the number of the plurality of LED channels is n, the number of channel current controllers and sample/hold units is n.

Two LED channels LEDCH1 and LEDCH2 respectively include four LEDs, however this is to schematically show the LED channel. The number of LEDs may be determined according emitting luminance required of the LED channel. Four LEDs included in two LED channels LEDCH1 and LEDCH2 are connected in series, and a voltage generated to the ends of the two LED channels LEDCH1 and LEDCH2 are channel voltages CH1 and CH2. The two LED channels LEDCH1 and LEDCH2 are applied with a power source voltage VLED.

The voltage between both terminals of the LED channel LEDCH1 is a voltage of which the channel voltage CH1 is subtracted from the power source voltage VLED, and the voltage between both terminals of the LED channel LEDCH2 is a voltage of which the channel voltage CH2 is subtracted from the power source voltage VLED.

The channel current controller 210 is controlled for the driving current to flow to the LED channel LEDCH1. The channel current controller 210 may control the driving current of the LED channel LEDCH1 according to a dimming signal DM1 having a predetermined duty. In detail, the channel current controller 210 controls the driving current having a predetermined magnitude during the duty of the dimming signal DM1 to flow to the LED channel LEDCH1.

The channel current controller 220 is controlled for the driving current to flow to the LED channel LEDCH2. The channel current controller 220 may control the driving current of the LED channel LEDCH2 according to the dimming signal DM2 having a predetermined duty. In detail, the channel current controller 220 controls the driving current having a predetermined magnitude during the duty of the dimming signal DM2 to flow to the LED channel LEDCH2.

The channel controller 100 generates the dimming signal DM1 and the dimming signal DM2 and transmits them to the channel current controller 210 and the channel current controller 220. The channel controller 100 generates the dimming signal DM1 and the dimming signal DM2 according to the emitting luminance required of each LED channel, and transmits them to the channel current controllers 210 and 220. That is, the dimming signal DM1 and the dimming signal DM2 are signals that control the on/off of the LED channels LEDCH1 and LECH2, respectively. In an embodiment of the present invention, a high level of the dimming signals DM1 and DM2 is the signal that turns on the LED channel and the low level is a signal that turns off the LED channel.

The sample/hold unit 310 samples and holds the minimum voltage (hereinafter, the first channel minimum voltage) CHmin1 of the channel voltage CH1.

The sample/hold unit 320 samples and holds the minimum voltage (hereinafter, the second channel minimum voltage) CHmin2 of the channel voltage CH2.

The minimum voltage detector 400 detects the further smaller voltage among the first and second channel minimum voltages CHmin1 and CHmin2 transmitted from the sample/hold units 310 and 320 to generate the minimum voltage Vmin.

The second error amplifier 600 compares the predetermined reference voltage VR2 and the minimum voltage Vmin to generate an error signal VE. The capacitor C is connected to the output terminal of the second error amplifier 600 such that the noise of the error signal VE is removed and the feedback loop is stable. The error signal VE is feedback information required to control the power source voltage VLED.

The second error amplifier 600 includes an inversion terminal (−) input with the minimum voltage Vmin and a non-inversion terminal (+) input with the reference voltage VR2, and amplifies the voltage of which the minimum voltage Vmin is subtracted to the reference voltage VR2 into a predetermined gain to generate the error signal VE.

The first error amplifier 500 amplifies the difference between the divided voltage VD that the power source voltage VLED is allocated according to the resistance ratio of the resistor R1 and the resistor R2, and the reference voltage VR1, to generate an overvoltage sensing voltage OVR. In an embodiment of the present invention, the resistors R1 and R2 are used to allocate the power source voltage VLED, however the present invention is not limited thereto. The divided voltage VD is the voltage corresponding to the power source voltage VLED. Two capacitors coupled in series instead of the resistor R1 and the resistor R2 may be used to generate the divided voltage VD.

The first error amplifier 500 amplifies the voltage of which the divided voltage VD is subtracted from the reference voltage VR1 into the predetermined gain to generate the overvoltage sensing voltage OVR. The reference voltage VR1 as the predetermined voltage to judge the overvoltage of the power source voltage VLED may be determined as the lower voltage than the voltage that the highest voltage among the range of the permitted power source voltage VLED is allocated by the resistance ratio R2/(R1+R2) of the resistor R1 and the resistor R2 by a predetermined margin.

The power source supplying device 700 is input with the error signal VE and the overvoltage sensing voltage OVR, and controls the power source voltage VLED. The power source supplying device 700 increases or decreases the power source voltage VLED according to the error signal VE, and if the overvoltage sensing voltage OVR is the voltage that is less than the predetermined overvoltage reference voltage, the power source voltage VLED is maintained as the threshold voltage OVTH. Here, the threshold voltage OVTH may be determined as the voltage that is less than the level that the power source voltage VLED is determined as the overvoltage by the predetermined margin. The overvoltage reference voltage may be determined as the overvoltage reference voltage when the power source voltage VLED is the threshold voltage OVTH. The period in which the power source voltage VLED is maintained as the threshold voltage OVTH is referred to as an overvoltage regulation period.

The divided voltage VD is input to the inversion terminal of the first error amplifier 500 and the non-inversion terminal is input with the reference voltage, such that if the overvoltage sensing voltage OVR is less than the overvoltage reference voltage, the overvoltage regulation period OVRP (referring to FIG. 2) is started.

In contrast, the inversion terminal of the first error amplifier 500 is input with the reference voltage and the non-inversion terminal is input with the divided voltage VD, and if the overvoltage sensing voltage OVR is the voltage of more than the overvoltage reference voltage, the overvoltage regulation period OVRP is started.

The power source supplying device 700 may be realized by a DC-DC converter, and the duty of the power source (not shown) controlling the operation of the DC-DC converter is controlled according to the error signal VE. In the case in which the power source voltage VLED is decreased, the minimum voltage Vmin is decreased and the error signal VE is increased. The power source supplying device 700 increases the duty of the power source in the case in which the error signal VE is increased to increase the power source voltage VLED.

In contrast, in the case in which the power source voltage VLED is increased, the minimum voltage Vmin is increased and the error signal VE is decreased. The power source supplying device 700 decreases the duty of the power source in the case in which the error signal VE is decreased to decrease the power source voltage VLED. By this method, the power source supplying device 700 uniformly maintains the power source voltage VLED.

Although the power source supplying device 700 controls the power source voltage VLED in this way, the power source voltage VLED may be the overvoltage. This is because the error signal VE is the feedback delay generated when the power source supplying device 700 is transmitted. Accordingly, the power source supplying device 700 controls the power source voltage VLED by using the overvoltage sensing voltage OVR such that the power source voltage VLED is not increased over the threshold voltage OVTH. That is, the power source supplying device 700 maintains the power source voltage VLED as the threshold voltage OVTH in the case in which the power source voltage VLED reaches the threshold voltage OVTH.

The duty of the power source is controlled according to the overvoltage sensing voltage OVR during the overvoltage regulation period OVRP. That is, if the voltage sensing voltage OVR is less than the overvoltage reference voltage, the power source supplying device 700 controls the duty of the power source such that the overvoltage sensing voltage OVR is maintained as the overvoltage reference voltage. Thus, the power source voltage VLED is maintained as the threshold voltage OVTH.

For example, the overvoltage reference voltage may be set as 0. If the overvoltage sensing voltage OVR is a voltage that is less than 0, the power source supplying device controls the duty of the power source such that the overvoltage sensing voltage OVR is maintained as 0, that is, the divided voltage VD is maintained as the same voltage as the reference voltage VR1. Here, the reference voltage VR1 may be set as an appropriate voltage to maintain the power source voltage VLED as the threshold voltage OVTH.

Next, a driving method of an LED emitting device according to an embodiment of the present invention will be described with reference to FIGS. 2 and 3.

Figure 2:
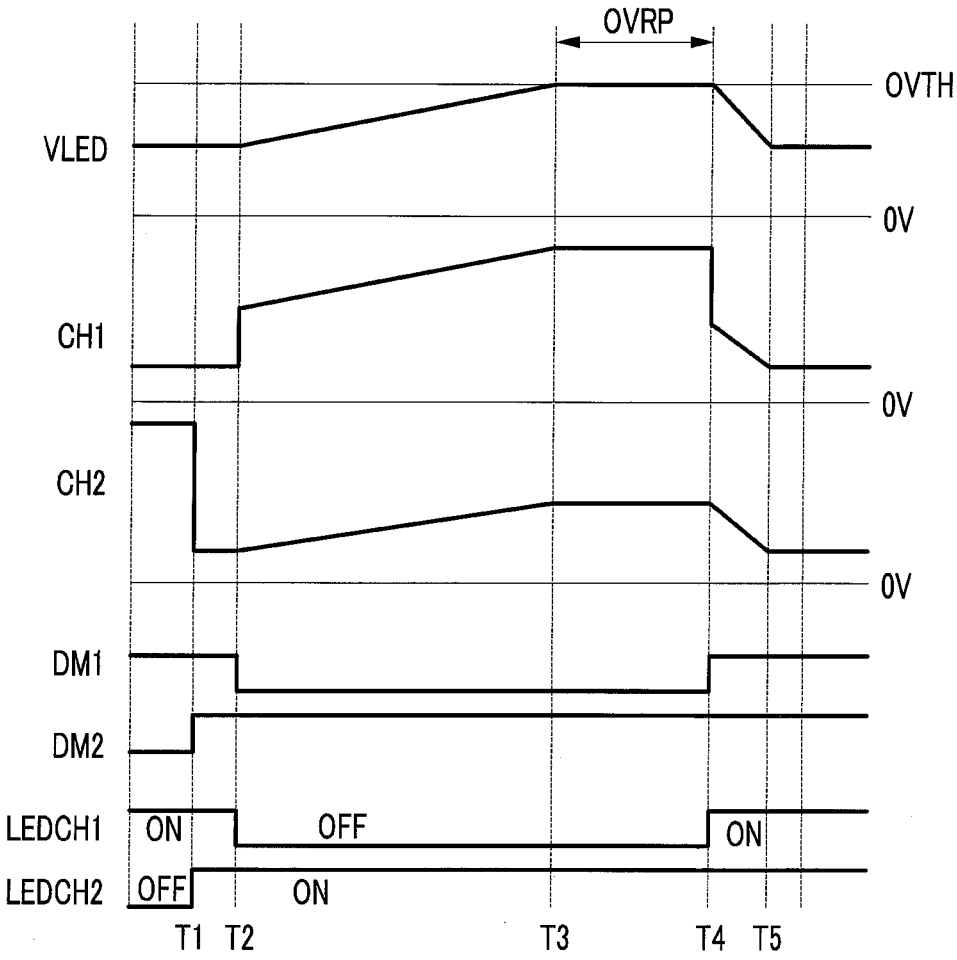
FIG. 2 is a waveform diagram showing a power source voltage, a channel voltage, and a channel state of an LED emitting device according to an embodiment of the present invention.

FIG. 2 is a waveform diagram showing a power source voltage, a channel voltage, and a channel state of an LED emitting device according to an embodiment of the present invention. In FIG. 2, the power source voltage VLED is increased by the turn-off of the LED channel LEDCH1, however the present invention is not limited thereto.

The power source voltage VLED must be the value of which the current source driving minimum voltage to drive the current source of each channel is added to the highest threshold voltage among the plurality of LED channels. This voltage is referred to as a power source threshold voltage. When the power source voltage VLED is a voltage that is less than the power source threshold voltage, a channel that is not operated among the plurality of LED channels may be generated.

Figure 3:
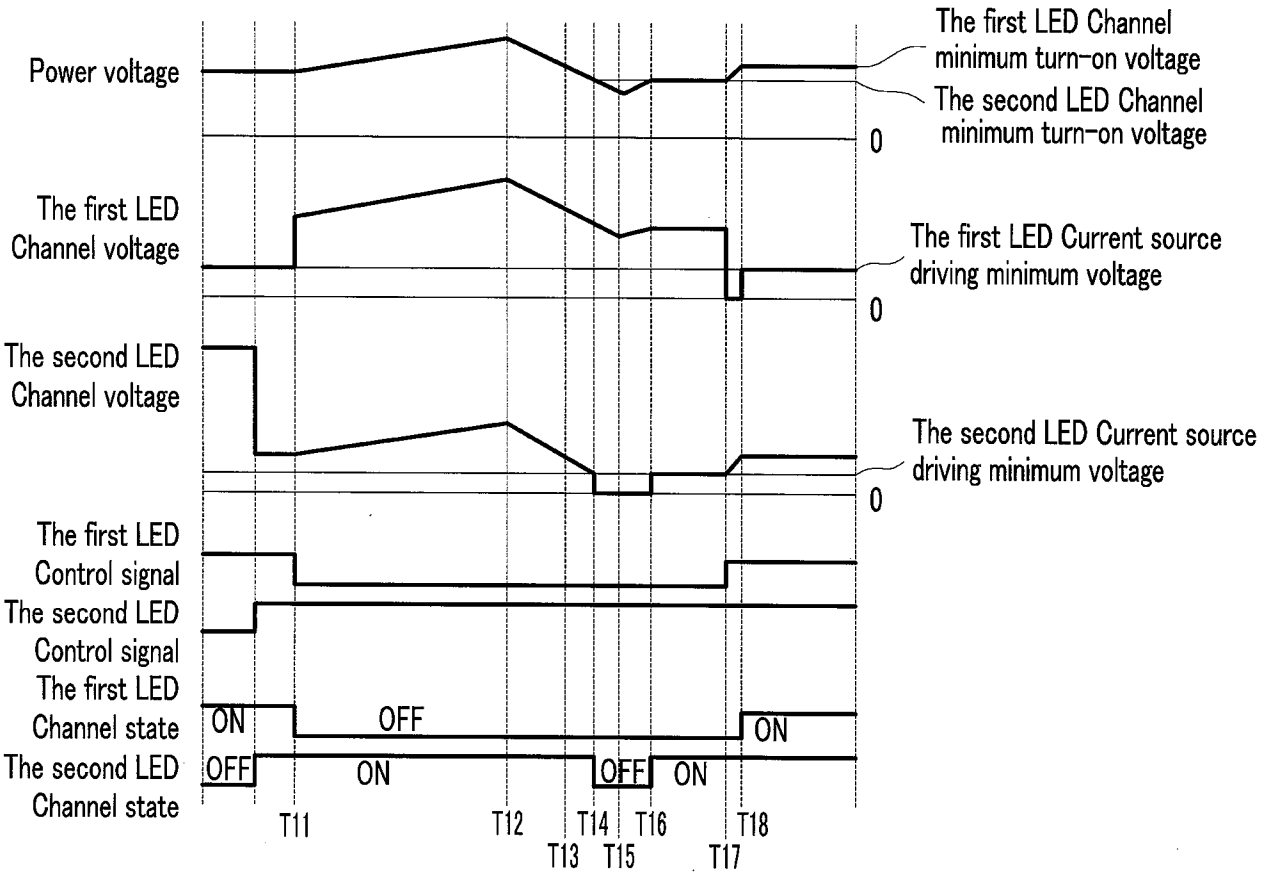
FIG. 3 is a waveform diagram showing a power source voltage, a channel voltage, and a channel state generated in a case in which a power source voltage is controlled by a conventional type.

FIG. 3 is a waveform diagram showing a power source voltage, a channel voltage, and a channel state generated in a case in which a power source voltage is controlled as a conventional type.

As shown in FIG. 2, the LED channel LEDCH2 is turned on at the time T1, and the two LED channels LEDCH1 and LEDCH2 are turned on during the period T1-T2. Before the time T1, the LED channel LEDCH2 is turned off such that the channel voltage CH2 of the LED channel LEDCH2 is maintained as a similar voltage to the power source voltage VLED. The minimum voltage Vmin is the first channel minimum voltage CHmin1 of the LED channel LEDCH1 that is sampled before the time T1.

After the time T1, the power source supplying device 700 increases the output power source to supply the current required for two LED channels. Here, it is shown that the power source voltage VLED is constantly maintained during the time T1-T2, however the present invention is not limited thereto, and the power source voltage VLED may be constantly maintained after the power source voltage VLED is decreased or increased.

If the LED channel LEDCH1 is turned off at the time T2, the power source voltage VLED starts to increase. The LED channel LEDCH1 is turned off in the state in which the output power source of the power source supplying device 700 is high to supply to the current to two channels such that the power source voltage VLED is increased.

As described above, the power source supplying device 700 controls the power source voltage VLED according to the error signal VE. The error signal VE is the signal generated according to the minimum voltage Vmin such that the output power source of the power source supplying device 700 is uniform during the time in which the minimum voltage Vmin is maintained as the first channel minimum voltage CHmin1 of the LED channel LEDCH1 sampled before the time T1. Accordingly, the power source voltage VLED starts to be increased from the turn-off time of the LED channel LEDCH1.

The LED channel LEDCH1 is turned off from the time T2 such that the channel voltage CH1 of the LED channel LEDCH1 is the similar voltage to the power source voltage VLED, and thereby the channel voltage CH1 of the LED channel LEDCH1 is increased from the time T2. The channel voltage CH2 of the LED channel LEDCH2 is the difference of the voltage between both terminals of the LED channel LEDCH2 from the power source voltage VLED such that it is increased together according to the increasing of the power source voltage VLED.

If the increased power source voltage VLED reaches the threshold voltage OVTH at the time T3, the power source voltage VLED is maintained as the threshold voltage OVTH from the time T3, and the channel voltage CH1 of the LED channel LEDCH1 is constantly maintained. The channel voltage CH2 of the LED channel LEDCH2 is also constantly maintained after the time T3.

If the LED channel LEDCH1 is again turned on at time T4, the power source voltage VLED starts to decrease. Here, the power source voltage VLED is a sufficient voltage to turn on two LED channels LEDCH1 and LEDCH2 such that the LED channel LEDCH1 is directly turned on. From the time T4, the power source voltage VLED is less than the threshold voltage OVTH such that the power source supplying device 700 controls the power source voltage VLED according to the error signal VE.

After the time T5, the power source voltage VLED is constantly maintained as the power source threshold voltage.

The effect of the present invention will be described compared with the conventional LED emitting device that does not include the overvoltage regulation period OVRP with reference to FIG. 3.

As shown in FIG. 3, if the first LED channel among two LED channels is turned off at the time T11, the power source voltage starts to increase. At the time T12, the power source voltage starts to decrease according to the overvoltage protection operation. If the power source voltage is decreased, the second LED channel voltage is also decreased. At the time T13, the second LED channel voltage that is continuously tracked is the voltage that is less than the first LED voltage that is sampled to the time T13 and is maintained.

Thus, the minimum voltage is changed to the second LED channel voltage from the time T13. The decreased power source voltage is lower than the minimum turn-on voltage of the second LED channel at the time T14 such that the second LED channel may not maintain the turn-on state. The second LED channel voltage becomes smaller than the minimum voltage required to sink the current to the second LED channel that is the current source driving minimum voltage of the second LED at the time T14. Thus, the current does not flow to the second LED channel.

The second LED control signal is in the on state at the time T14 such that the switch connected between the second LED channel and the ground terminal is turned on by the second LED control signal, and the second LED channel voltage becomes the voltage close to 0. The minimum voltage is the second LED channel voltage from the time T14 such that the power source voltage is controlled with reference to the second LED channel voltage.

If the power source voltage becomes the voltage level such that the overvoltage protection operation is lifted at the time T15, the overvoltage protection operation is lifted such that the power source voltage starts to be increased. The power source voltage starts to be higher than the minimum turn-on voltage of the second LED channel from the time T16, and the second LED channel voltage starts to be higher than the second LED current source driving minimum voltage such that the second LED channel is turned on.

If the first LED control signal turning on the first LED channel is input at the time T17, the first LED channel voltage becomes the voltage close to 0. The power source voltage is lower than the first LED channel minimum turn-on voltage at the time T17, and the first LED channel voltage is smaller than the first LED current source driving minimum voltage. Accordingly, although the first LED control signal that turns on the first LED channel is input, the first LED channel is not turned on.

The minimum voltage is changed to the first LED channel voltage at the time T17, and the LED emitting device increases the power source voltage according to the lowered minimum voltage.

If it reaches the time T18, the power source voltage becomes the minimum turn-on voltage of the first LED channel, and the first LED channel voltage becomes the first LED current source driving minimum voltage. Thus, the first LED channel is turned on, and the power source voltage starts to be constantly maintained.

As shown in the conventional art, the problem that the second LED channel is not turned on during the period T14-T16 in which the second LED control signal that turns on the second LED channel is input is not generated. Also, the problem that the first LED channel is turned on during the period T17-18 in which the first LED control signal that turns on the first LED channel is input is not generated.

The present invention sets up the overvoltage regulation period OVRP that maintains the power source voltage as a predetermined threshold voltage to solve this problem. Thus, the power source voltage is decreased by the overvoltage protection operation, and thereby the problem that the LED channel may be turned on at the desired time may be solved.

The drawings and the detailed description described above are examples for the present invention and are provided to explain the present invention, and the scope of the present invention described in the claims is not limited thereto. Therefore, it will be appreciated to those skilled in the art that various modifications can be made and other equivalent embodiments are available. Accordingly, the actual scope of the present invention must be determined by the spirit of the appended claims.

DESCRIPTION OF SYMBOLS

LED emitting device 1, LED channel LEDCH1 and LEDCH2 channel controller 100, channel current controller 210 and 220 sample/hold unit 310 and 320, minimum voltage detector 400 first error amplifier 500, second error amplifier 600 power source supplying device 700, dividing resistors R1 and R2 capacitor C, power source voltage VLED, channel voltage CH1 and CH2 overvoltage sensing voltage OVR, threshold voltage OVTH divided voltage VD, reference voltage VR1 and VR2

What is claimed is:

1. An LED emitting device including at least two LED channels, comprising:

a power source supplying device supplying a power source voltage to one terminal of at least two LED channels; and at least two channel current controllers connected to the other terminal of the at least two LED channels, and controlling a duty of a driving current respectively flowing in at least two LED channels, wherein the power source supplying device maintains the power source voltage as a threshold voltage during an overvoltage regulation period if the power source voltage reaches a predetermined threshold voltage.

2. The LED emitting device of claim 1, wherein the LED emitting device further includes a first error amplifier amplifying a voltage of which a divided voltage corresponding to the power source voltage is subtracted from a predetermined reference voltage to generate an overvoltage sensing voltage, and the power source supplying device maintains the power source voltage as the threshold voltage if the overvoltage sensing voltage becomes a voltage that is less than a predetermined overvoltage reference voltage.

3. The LED emitting device of claim 2, wherein
the overvoltage reference voltage is set as the overvoltage sensing voltage when the power source voltage is the threshold voltage.

4. The LED emitting device of claim 1, wherein
the LED emitting device further includes
a first error amplifier amplifying the voltage of which the predetermined reference voltage is subtracted from the divided voltage corresponding to the power source voltage to generate an overvoltage sensing voltage, and
the power source supplying device
maintains the power source voltage as the threshold voltage if the overvoltage sensing voltage is the larger voltage than the predetermined overvoltage reference voltage.

5. The LED emitting device of claim 4, wherein
the overvoltage reference voltage is set
as the overvoltage sensing voltage when the power source voltage is the threshold voltage.

6. The LED emitting device of claim 1, wherein
the LED emitting device further includes:
at least two sample/hold units sampling and holding a channel minimum voltage of each channel voltage of the at least two LED channel; and
a minimum voltage detector detecting the smaller voltage among at least two channel minimum voltages to generate as a minimum voltage, and
the power source supplying device controls
the power source voltage by using an error signal generated by amplifying the difference between the minimum voltage and the predetermined reference voltage such that the minimum voltage becomes the same voltage as the reference voltage.

7. The LED emitting device of claim 6, wherein
the LED emitting device further includes
a first error amplifier amplifying a voltage of which a divided voltage corresponding to the power source voltage is subtracted from a predetermined reference voltage to generate an overvoltage sensing voltage, and
the power source supplying device
maintains the power source voltage as the threshold voltage if the overvoltage sensing voltage becomes the voltage that is less than a predetermined overvoltage reference voltage.

8. The LED emitting device of claim 6, wherein
the LED emitting device further includes
a first error amplifier amplifying the voltage of which the predetermined reference voltage is subtracted from the divided voltage corresponding to the power source voltage to generate an overvoltage sensing voltage, and
the power source supplying device
maintains the power source voltage as the threshold voltage if the overvoltage sensing voltage is the larger voltage than the predetermined overvoltage reference voltage.

9. A method for driving an LED emitting device including at least two LED channels, comprising:
supplying a power source voltage to one terminal of at least two LED channels; and
maintaining the power source voltage as a threshold voltage during an overvoltage regulation period if the power source voltage reaches a predetermined threshold voltage.

10. The method of claim 9, further comprising:
amplifying a voltage of which a divided voltage corresponding to the power source voltage is subtracted from a predetermined reference voltage to generate an overvoltage sensing voltage; and
maintaining the power source voltage as the threshold voltage if the overvoltage sensing voltage becomes the voltage that is less than a predetermined overvoltage reference voltage.

11. The method of claim 10, wherein
the overvoltage reference voltage is set
as the overvoltage sensing voltage when the power source voltage is the threshold voltage.

12. The method of claim 9, further comprising:
amplifying the voltage of which the predetermined reference voltage is subtracted from the divided voltage corresponding to the power source voltage to generate an overvoltage sensing voltage; and
maintaining the power source voltage as the threshold voltage if the overvoltage sensing voltage is the larger voltage than the predetermined overvoltage reference voltage.

13. The method of claim 12, wherein
the overvoltage reference voltage is set
as the overvoltage sensing voltage when the power source voltage is the threshold voltage.

14. The method of claim 9, further comprising:
sampling and holding a channel minimum voltage of each channel voltage of the at least two LED channels;
detecting the smaller voltage among at least two channel minimum voltages to generate as a minimum voltage; and
controlling the power source voltage by using an error signal generated by amplifying the difference between the minimum voltage and the predetermined reference voltage such that the minimum voltage becomes the same voltage as the reference voltage.

15. The method of claim 14, further comprising:
amplifying a voltage of which a divided voltage corresponding to the power source voltage is subtracted from a predetermined reference voltage to generate an overvoltage sensing voltage; and
maintaining the power source voltage as the threshold voltage if the overvoltage sensing voltage becomes the voltage that is less than a predetermined overvoltage reference voltage.

16. The method of claim 14, further comprising:
amplifying the voltage of which the predetermined reference voltage is subtracted from the divided voltage corresponding to the power source voltage to generate an overvoltage sensing voltage; and
maintaining the power source voltage as the threshold voltage if the overvoltage sensing voltage is the larger voltage than the predetermined overvoltage reference voltage.

* * * * *